US008141290B2

(12) United States Patent
LaFrance et al.

(10) Patent No.: US 8,141,290 B2
(45) Date of Patent: Mar. 27, 2012

(54) MACHINE GUN ACCESSORY MOUNT

(75) Inventors: Timothy F LaFrance, Newport Beach, CA (US); Michael D Picciotta, Yorba Linda, CA (US)

(73) Assignee: SureFire, LLC, Fountain Valley, CA (US)

( * ) Notice: Subject to any disclaimer, the term of this patent is extended or adjusted under 35 U.S.C. 154(b) by 426 days.

(21) Appl. No.: 12/343,971

(22) Filed: Dec. 24, 2008

(65) Prior Publication Data

US 2010/0154280 A1 Jun. 24, 2010

(51) Int. Cl.
*F41C 27/00* (2006.01)

(52) U.S. Cl. ..... 42/90; 42/72; 42/124; 248/309.1; 248/230.1

(58) Field of Classification Search ..... 42/85, 90, 42/124, 127, 72; 89/9, 37.03, 36.06; 24/525, 24/569; 248/309.1, 230.1, 521, 523, 511; 403/374.3

See application file for complete search history.

(56) References Cited

U.S. PATENT DOCUMENTS

| | | | | | |
|---|---|---|---|---|---|
| 2,363,563 | A * | 11/1944 | Vinson | 89/14.1 |
| 2,870,679 | A * | 1/1959 | Collins | 89/14.2 |
| 2,900,875 | A * | 8/1959 | Fergus et al. | 89/14.3 |
| 3,368,454 | A * | 2/1968 | Peck et al. | 89/14.05 |
| 4,716,809 | A * | 1/1988 | A'Costa | 89/14.3 |
| 5,704,155 | A | 1/1998 | Primeau, IV | |
| 6,276,088 | B1 | 8/2001 | Matthews et al. | |
| 6,318,230 | B1 * | 11/2001 | Bamber | 89/14.5 |
| 6,378,237 | B1 | 4/2002 | Matthews et al. | |
| 6,508,027 | B1 | 1/2003 | Kim | |
| 6,622,416 | B2 | 9/2003 | Kim | |
| 6,655,069 | B2 | 12/2003 | Kim | |
| 6,779,288 | B1 | 8/2004 | Kim | |
| 6,854,206 | B2 * | 2/2005 | Oz | 42/124 |
| 6,895,708 | B2 | 5/2005 | Kim et al. | |
| 7,117,624 | B2 | 10/2006 | Kim | |
| 7,559,167 | B1 * | 7/2009 | Moody et al. | 42/72 |
| 7,770,505 | B2 * | 8/2010 | McClellan et al. | 89/36.06 |
| 2003/0230022 | A1 * | 12/2003 | Battaglia | 42/111 |
| 2004/0103577 | A1 * | 6/2004 | Compton | 42/85 |
| 2006/0288626 | A1 * | 12/2006 | Kim | 42/73 |
| 2008/0155876 | A1 | 7/2008 | Matthews et al. | |

* cited by examiner

*Primary Examiner* — Gabriel Klein
(74) *Attorney, Agent, or Firm* — Haynes and Boone, LLP

(57) ABSTRACT

A universal accessory mount for a heavy machine gun includes an annular base adapted to be disposed concentrically over a front end of a shroud of the gun and having diametrically opposing upper and lower accessory mounting tines extending forwardly therefrom. A holding mechanism pulls a planar floor of a counterbore in the rear of the base into contact with a planar front surface of the shroud of the gun. The holding mechanism includes a pair of threaded bolts extending rearwardly from the base through respective ones of a pair of diametrically opposing bolt apertures contained in the base, and a pair of cleats, each having an opening into which a rear end portion of a respective one of the bolts is received and a respective hook adapted to grip the shroud of the gun through a respective hole in the shroud.

21 Claims, 7 Drawing Sheets

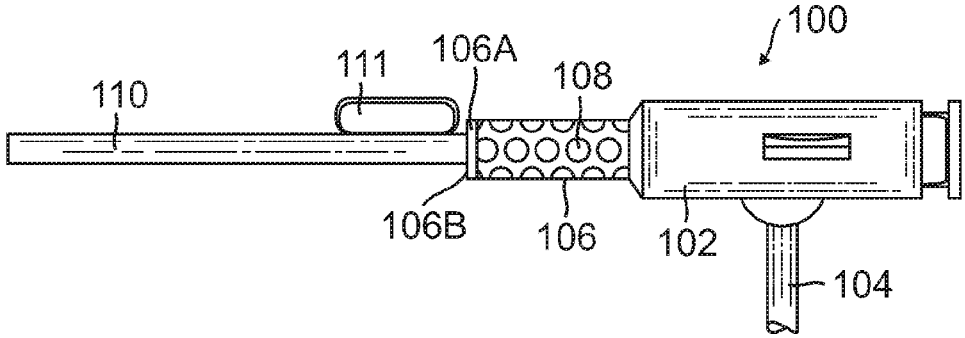
FIG. 17 - Prior Art
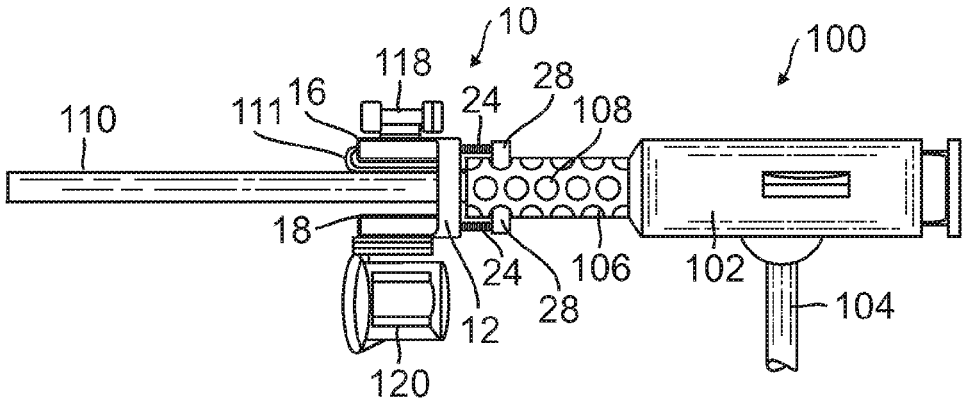
FIG. 18

MACHINE GUN ACCESSORY MOUNT

BACKGROUND

1. Technical Field

This disclosure relates to combat weaponry in general, and in particular, to accessory mounting devices for heavy machine guns.

2. Related Art

One of the more effective infantry combat weapons deployed by the United States and allied forces during both this and the last century has been the Browning .50 caliber M2HB heavy machine gun. It has been shown to be effective against infantry, lightly armored land vehicles and boats, light fortifications, and low-flying aircraft, and has been used extensively both as a vehicle-mounted weapon and for aircraft armament by the United States from 1927 to the present. It was used extensively during World War II, the Korean War, the Vietnam War and the war in Iraq. It is the primary heavy machine gun of NATO countries, and has also been used by many other countries. It is still in use today, with some modern innovations and improvements, and has been in use longer than any other small arm currently in the U.S. inventory.

One of the improvements to the gun that users have found particularly advantageous has been the ability to use a variety of accessories with it, such as advanced gun sighting devices and lighting devices for better illuminating the gun's field of fire in dim or dark lighting conditions. The former includes, for example, telescopic, laser, infrared (IR) and so-called "starlight" night vision device (NVD) gun sights, and the latter includes, for example, powerful IR and/or white light spotlights that are able to reveal enemy activity and illuminate targets at great distances in twilight or night conditions, such as the SureFire "HellFighter" heavy gun spotlight, model HF M2 HB, manufactured by SureFire, LLC, Fountain Valley, Calif.

As those of skill in this art will appreciate, in order to integrate such accessories with a heavy machine gun successfully, it is necessary to provide mechanisms for mounting the accessories on the gun that are able to withstand the rigors of adverse battlefield environmental conditions as well as the extremes of shock and vibration of the gun when fired. Over the years, a number of gun accessory mounts have been developed, examples of which can be found in the patent literature, including, e.g., in U.S. Pat. Nos. 5,704,155 to D. Primeau, IV; 6,508,027, 6,655,069, and 6,779,288 to P. Kim; and, 6,895,708 to P. Kim et al.

While these previous gun accessory mounts address some of the above accessory-to-gun integration issues to some extent, they are not without certain drawbacks when applied to heavy machine guns such as the M2HB, including that some cannot be used with guns having ballistic shields, some have clamping lugs that do not accommodate the various gun shroud hole patterns found in different models of heavy machine guns without some modification of the shroud and/or the lugs, some cannot be used with guns that incorporate a quick change barrel (QCB), and some locate a spotlight accessory at a position relative to the barrel of the gun such that extensive firing of the gun can result in the gunner's view of the field of fire being obscured by a "whiteout" effect.

Accordingly, what is needed is a more "universal" heavy machine gun accessory mount that is light in weight, yet sufficiently robust to withstand adverse environmental conditions and the shock and vibrations of the gun during firing, and which is also capable of reliably mounting a variety of accessories on virtually any model of heavy machine gun in use today, regardless of the gun's shroud hole pattern or diameter and whether or not it incorporates a ballistic shield or a QCB.

BRIEF SUMMARY

In accordance with the present disclosure, universal, light weight, yet robust heavy machine gun accessory mounts are provided that are capable of withstanding harsh environmental conditions and the shock and vibration of the gun firing, and which are also capable of reliably mounting a variety of target sighting and illuminating accessories on virtually any model of heavy machine gun, regardless of its particular configuration.

In one example embodiment, an accessory mount for a heavy machine gun comprises a base configured for attachment of the accessory mount to the gun, a pair of diametrically opposing accessory mounting tines extending forwardly from the base, and a holding mechanism for fixing the position of the base in relation to the gun.

The base may comprise an annular structure having a circular central opening configured to be disposed concentrically over a barrel of the gun, and a concentric counterbore extending into a rear surface thereof. The counterbore defines a planar floor and is configured to be disposed concentrically over a front end of a shroud of the gun, with the planar floor in contact with a planar front surface of the shroud. The tines comprise a pair of diametrically opposing upper and lower accessory mounting tines that extend forwardly from the base.

The holding mechanism may comprise a pair of threaded bolts that extend rearwardly from the base through respective ones of a pair of diametrically opposing bolt apertures contained therein. Each of a pair of mounting cleats has an opening into which a rear end portion of a respective one of the bolts is received, and a hook adapted to grip an edge of a corresponding hole in the shroud of the gun. In one embodiment, the opening in at least one of the cleats is threaded, and a corresponding one of the threaded bolts is disposed in threaded engagement with the opening of the cleat. In another embodiment, the opening in at least one of the cleats is unthreaded, and the corresponding bolt is disposed in threaded engagement with a threaded nut disposed behind the cleat.

The cleats are arranged such that advancement of the bolts into respective ones of the cleats causes the hook of each cleat to grip an edge of the corresponding hole in the shroud, and the planar floor of the counterbore in the rear surface of the base to be pulled into contact with and held against the planar front surface of the shroud. At least one accessory mounting rail is mounted on a surface of a forward end portion of at least one of the upper and lower tines of the mount and can be used to mount a variety of gun accessories, such as gun sights and spotlights, to a variety of different gun configurations.

A better understanding of the above and many other features and advantages of the novel heavy machine gun accessory mounts of the present invention can be obtained from a consideration of the detailed description of some example embodiments thereof below, particularly if such consideration is made in conjunction with the appended drawings, wherein like reference numerals are used to identify like elements illustrated in one or more of the figures thereof.

BRIEF DESCRIPTION OF THE DRAWINGS

FIG. 17 is a partial left side elevation view of a .50 caliber heavy machine gun of a type to which the mounts of the present invention have advantageous application;

FIG. 18 is a partial left side elevation view of the .50 caliber heavy machine gun of FIG. 17 having an embodiment of the accessory mount of the present invention mounted thereon, showing a gun sight and a spotlight mounted on the mount;

DETAILED DESCRIPTION

Figure 1:
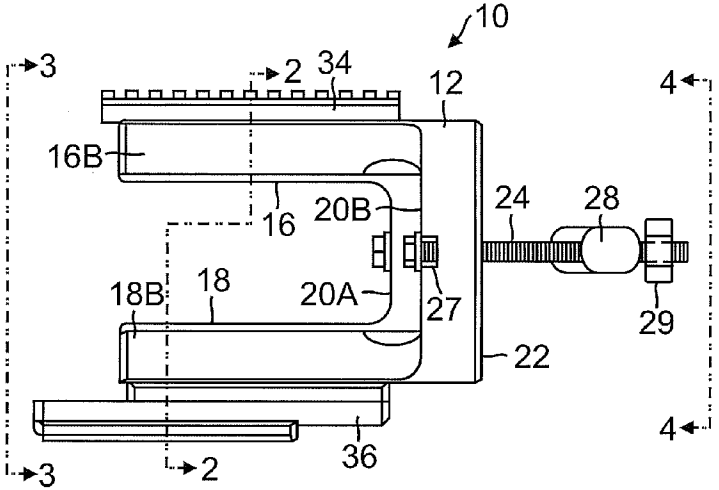
FIG. 1 is left side elevation view of an example embodiment of a short-tined heavy machine gun accessory mount in accordance with the present disclosure.

FIG. 1 is left side elevation view of an example embodiment of a heavy machine gun accessory mount 10 in accordance with the present disclosure. With reference to FIGS. 1-4, the example accessory mount comprises an annular base 12 containing a cylindrical opening or lumen 14 that is adapted to be disposed concentrically about the barrel 110 and barrel shroud 106 of a heavy machine gun 100 (see FIG. 17) on which the accessory mount 10 is to be mounted, and to permit reciprocating axial recoil of the barrel relative to the base during firing of the recoil-operated weapon.

With reference to FIG. 17, the host machine gun 100 includes a receiver 102 that is typically mounted on a stand 104 of a type that enables a barrel 110 of the gun to be traversed left and right and elevated up and down. The gun 100 further includes a shroud 106 that includes a bushing 106A having a substantially planar front surface 106B, and incorporates a plurality of generally circular holes 108 disposed in a regular pattern. The elongated, rifled barrel 110 of the gun is supported by the shroud 106 and the receiver 102 to move axially in a reciprocating manner relative to the shroud and receiver, and hence, the accessory mount 10 mounted thereto, during firing of the gun 100.

Figure 2:
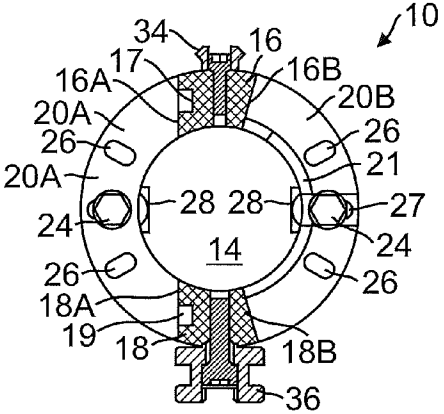
FIG. 2 is a cross-sectional view of the example accessory mount of FIG. 1, as seen along the lines of the section 2-2 taken therein.
Figure 3:
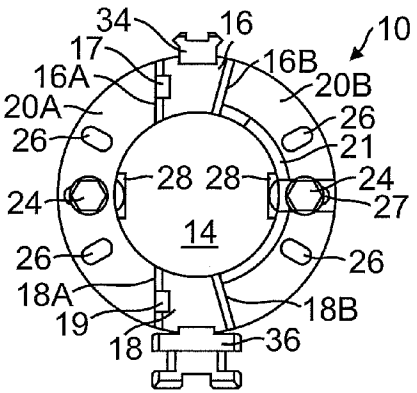
FIG. 3 is a front end elevation view of the accessory mount of FIG. 1, as seen along the lines of the section 3-3 taken therein.
Figure 4:
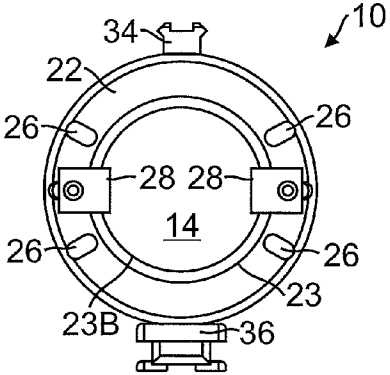
FIG. 4 is a rear end elevation view of the accessory mount of FIG. 1, as seen along the lines of the section 4-4 taken therein.
Figure 5:
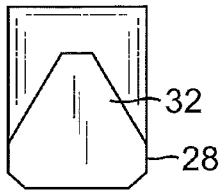
FIG. 5 is a front elevation view of an example embodiment of a novel mounting cleat of the accessory mount.

With reference to FIGS. 1-4, a pair of diametrically opposing upper and lower accessory mounting tines 16 and 18 extend forwardly from the base 12. As illustrated in FIG. 4, the base 12 includes a rear surface 22 having an axial counterbore 23 extending into it. The counterbore defines a substantially planar ledge or floor 23B. When the counterbore 23 of the base 12 is disposed concentrically over the front end of the bushing 106A at the front end of the barrel shroud 106 (see FIG. 17), the floor 23B of the counterbore 23 seats against the planar front surface 106B of the shroud 106. As discussed in more detail below, a holding mechanism is provided for pulling the floor 23B of the counterbore 23 against, and holding it firmly in contact with, the front surface 106B of the shroud 106.

Figure 6:
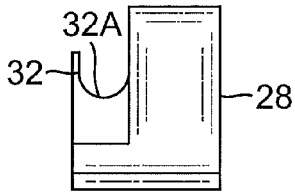
FIG. 6 is side elevation view of the example mounting cleat of FIG. 5.
Figure 7:
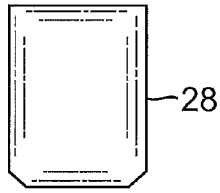
FIG. 7 is a rear elevation view of the mounting cleat.
Figure 8:
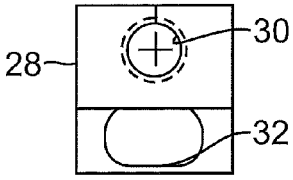
FIG. 8 is a top plan view of the mounting cleat.
Figure 9:
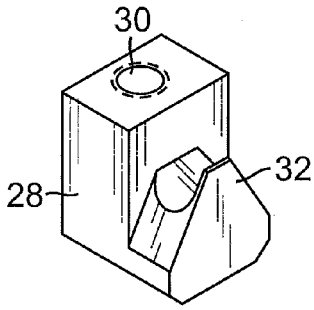
FIG. 9 is an upper front and side perspective view of the mounting cleat.

Referring to FIGS. 1-4, the holding mechanism comprises a pair of threaded bolts 24 extending rearwardly from the base 12 through respective ones of a pair of diametrically opposing bolt apertures 26 contained therein, and an associated pair of cleats 28. With reference to FIGS. 5-9, each of the cleats 28 includes an opening 30 (see FIGS. 8, 9) into which a rear end portion of a respective one of the bolts 24 is received, and a respective gripping hook 32 configured to grip a forward edge of a corresponding one of the circular openings 108 in the shroud 106 of the gun 100. With reference to FIG. 6, each of the hooks 32 of the cleats 28 includes an arcuate gripping surface 32A that is adapted to engage a correspondingly arcuate edge of the corresponding shroud hole 108. The cleats 28 are arranged such that advancement of the bolts 24 into respective ones of the cleats causes the hook 32 of each cleat to grip a forward edge of the corresponding hole 108 in the shroud 106 of the gun 100 and the planar floor 23B of the counterbore 23 in the rear surface 22 of the base 12 to be pulled into contact with and held against the planar front surface 106B of the shroud 106. In one embodiment, the openings 30 of the cleats 28 may be threaded so as to receive a rear end portion of a respective one of the threaded bolts 24 in complementary threaded engagement. In another embodiment discussed below, the opening 30 of at least one of the cleats 28 may be a through-opening, i.e., unthreaded, and as illustrated in FIG. 1, a rear end portion of the corresponding threaded bolt 24 may be received in threading engagement with a threaded nut 29 disposed behind the corresponding unthreaded cleat 28.

With reference to FIGS. 2-4, in one advantageous embodiment, the opposing pairs of bolt apertures 26 in the base 12 are slotted in the radial direction to accommodate gun shrouds 106 of different diameters, and in the embodiment illustrated, the bolt apertures comprise one of a plurality of diametrically opposing pairs of bolt apertures 26 arranged in a circumferential pattern around the base 12 in such a way as to enable the mounting cleats 28 of the mount 10 to grip the shrouds 106 of machine guns 100 having different shroud hole patterns. In the embodiment illustrated, the opposing aperture 26 pair pattern comprises a first pair of apertures disposed on a horizontal axis, and two additional pairs respectively disposed on axes rotated approximately ±30 degrees relative to the horizontal axis. This enables the base 12, and hence, the accessory mounting tines 16 and 18, to be mounted in a variety of angular positions relative to the barrel 110 and shroud 106 of a gun 100.

Advantageously, the foregoing mount holding mechanism eliminates the use of conventional threaded "ball socket" lugs on gun shrouds 106 in which the dimensions of the shroud holes 108 are not always consistent, resulting in a misfit between the lugs and the shroud 106, thereby necessitating modifications to the shroud 106 to avoid damaging it. The mount 10 of the present invention clamps firmly against the planar front end 106B of the front bushing 106A of the shroud 106, where the dimensions are relatively consistent. Additionally, the foregoing mount holding arrangement enables the mount 10 to be used on guns 100 with different shroud hole 108 patterns, e.g., 6-hole or 8-hole shroud patterns. Further, the novel holding mechanism enables the accessory mount 10 to be installed on a machine gun 100 with a quick change barrel (QCB) 110, such as the gun 100 illustrated in FIG. 17.

As shown in FIG. 17, guns 100 with QCBs 110 include a handle 111 coupled to the barrel slightly forward of the shroud 106. The handle 111 is used to rotate the barrel 110 about the long axis of the barrel and through an angular displacement of about ±60 degrees so as to enable the rear end of the barrel 110 to be quickly engaged in or disengaged from a corresponding barrel attachment receptacle (not illustrated) in the receiver 102 of the gun 100. Guns 100 with QCBs 110 cannot be used with ballistic shields 112 of the type illustrated in FIGS. 19 and 20 because the handle 111 would interfere with the shield 112. On the other hand, any accessory mount 10 that is to coupled to the front end of the shroud 106 of such guns must be adapted to accommodate such handles.

In the example accessory mount 10 of FIGS. 1-4, the mount includes features adapted to accommodate the handles 111 of a variety of guns 100 equipped with QCBs 110. As illustrated in FIGS. 1-3, the upper and lower accessory mounting tines 16 and 18 include respective right sides 16A and 18A that are generally coplanar with each other and parallel to a vertical plane passing through a center of the lumen 14 of the base 12. However, the respective left sides 16B and 18B of the tines 16 and 18 are respectively disposed in planes that pass through the center of the lumen 14 so as to subtend an angle of about 150 degrees between the two sides. Additionally, as shown in FIGS. 1 and 2, the front face 20B of the left side of the annular base 12 is recessed behind the front face 20A of the base, and further, includes a segment of an annular recess 21 adjacent to the central opening 14 of the base that is arranged to accommodate a rear end of a QCB handle 111. Further, the front face 20B of the of the left side of the annular base 12 includes a slot 27 straddling the middle bolt aperture 26 that enables the head of the threaded bolt 24 on the left side of the mount 10 to be recessed below the front face 20B of the base so as to clear the rear end of the QCB handle 111. When this arrangement is used, the aperture 30 of the corresponding cleat 28 on the left side of the mount 10 may be unthreaded, and a rear end portion of the left side threaded bolt 24 may be received in threading engagement with a threaded nut 29 disposed behind the corresponding unthreaded cleat 28, as illustrated in FIG. 1.

As illustrated in FIG. 18, in use, the mount 10 is mounted on the front end 106B of the shroud 106 of the machine gun 100 using an appropriate pair of the diametrically opposing bolt apertures 26 such that the accessory mounting tines 16 and 18 are disposed at an angle relative to the vertical, the base 12 is disposed rearward of the handle 111 of the QCB 110, and the handle 111 is free to rotate axially between the respective angulated left sides 16B and 18B of the two tines 16 and 18 with ample clearance. This enables the QCB 110 to be changed out, i.e., removed from the gun 100 and replaced with a new barrel 110, without having to remove the accessory mount 10 from the gun 100 or any of the accessories mounted thereon.

In this regard, referring again to FIGS. 1-4, the example accessory mount 10 further comprises one or more accessory mounting rails 34 and 36 mounted on respective upper and lower surfaces of respective ones of the upper and lower tines 16 and 18 of the mount with, e.g., a plurality of threaded fasteners 38. In the particular example embodiment illustrated, the mounting rail 34 disposed on the upper surface of the forward end portion of the upper mounting tine 16 comprises a standard "Picatinny" rail, useful for mounting various types of gun accessories, such as a gun sight 118, e.g. a telescopic, laser, infrared (IR) or night vision device (NVD) gun sight, as illustrated in FIG. 18. The larger accessory mounting rail 36 shown mounted on the lower surface of the forward end portion of the lower tine 18 may comprise, for example, a larger rail of a proprietary design adapted to mount, e.g., a spotlight 120 for illuminating the gun's field of fire with IR and/or white light in dim or dark lighting conditions.

Figure 19:
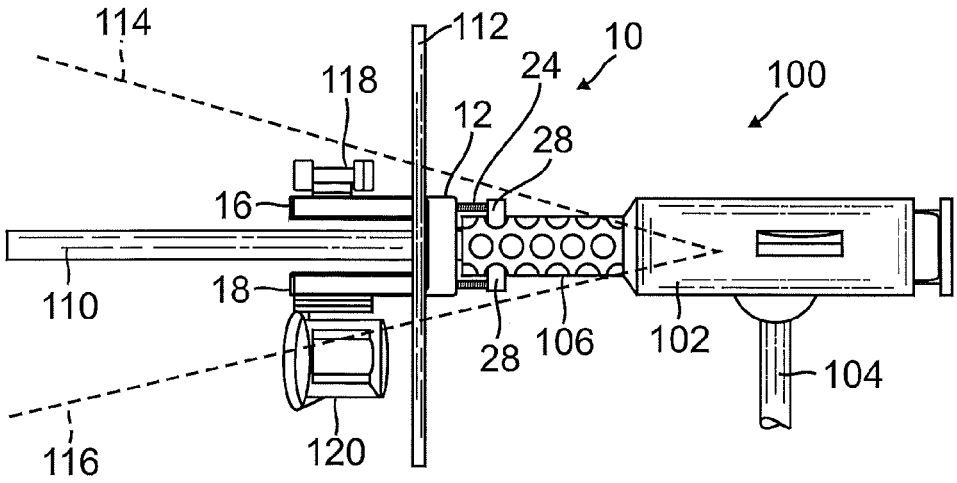
FIG. 19 is a partial left side elevation view of a .50 caliber heavy machine gun having a ballistic shield and an alternative embodiment of an accessory mount of the present invention mounted thereon, showing a gun sight and a spotlight mounted on the mount; and, FIG. 20 is a partial left side elevation view of a .50 caliber heavy machine gun having a ballistic shield and an embodiment of an accessory mount and a pair of the accessory side mounting clamps of the present invention mounted thereon, showing a gun sight and a spotlight mounted on the accessory mount.

It has been discovered that mounting a spotlight 120 on the lower surface of the lower tine 18 of the mount 10, and hence, below the barrel 110 of the gun 100, as illustrated in FIGS. 17-19, provides an important advantage relative to accessory mounts that position the spotlight level with or above the barrel. In particular, with extended firing of the gun, a cloud of smoke is produced by the atmospheric burning of the powder charges. If the spotlight 120 is mounted level with or above the barrel 110, the spotlight 120 will illuminate the smoke cloud, thereby resulting in a "whiteout" that obscures the gunner's view of the field of fire. However, by mounting the light 120 below the barrel 110 of the gun 100, the light does not illuminate the smoke, and the gunner retains a good view of the field of fire illuminated by the spotlight 120.

The accessory mount 10 can be manufactured by a variety of methods, including casting and machining, and can be fabricated of a variety of high strength materials. In one light weight yet robust embodiment capable of withstanding adverse battlefield environmental conditions and the shock and vibrations of the host gun 100 during extended firing, the base 12 and the upper and lower accessory mounting tines 16 and 18 may comprise a single, integral piece machined from a tube of an aluminum alloy, e.g. 6061-T6.

The cleats 28 are preferably also made of a strong metal, e.g., tool steel, and the accessory mounting rails 34 and 36 may advantageously be made of a light weight but strong metal, e.g., a 6061-T5 aluminum alloy extrusion that is hard anodized for corrosion protection.

Figure 10:
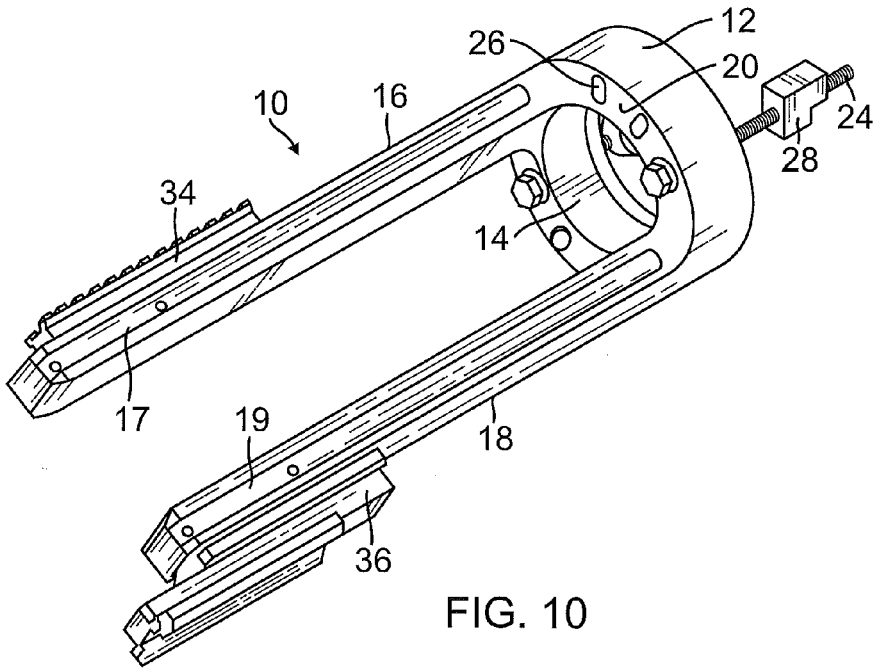
FIG. 10 is a front and upper right side perspective view of an alternative embodiment of the example accessory mount, showing elongated tines of the mount useful on a heavy machine gun equipped with a ballistic shield.

FIG. 10 is a front and upper side perspective view of an alternative embodiment of the example accessory mount 10 adapted for use on a heavy machine gun 100 equipped with a ballistic shield 112, as discussed below in connection with FIGS. 19 and 20, and differs from the mount 10 illustrated in FIGS. 1-4 mainly in the respective lengths of the accessory mounting tines 16 and 18, which are elongated to accommodate the ballistic shield 112. Additionally, the long-tined mount 10 of FIG. 10 omits the features that adapt the mount for use on a gun with a QCB 110, such as the angulated left sides 16B and 18B of the tines 16 and 18 and the recessed left front surface 20B and recess 21 of the embodiment of FIGS.

Figure 20:
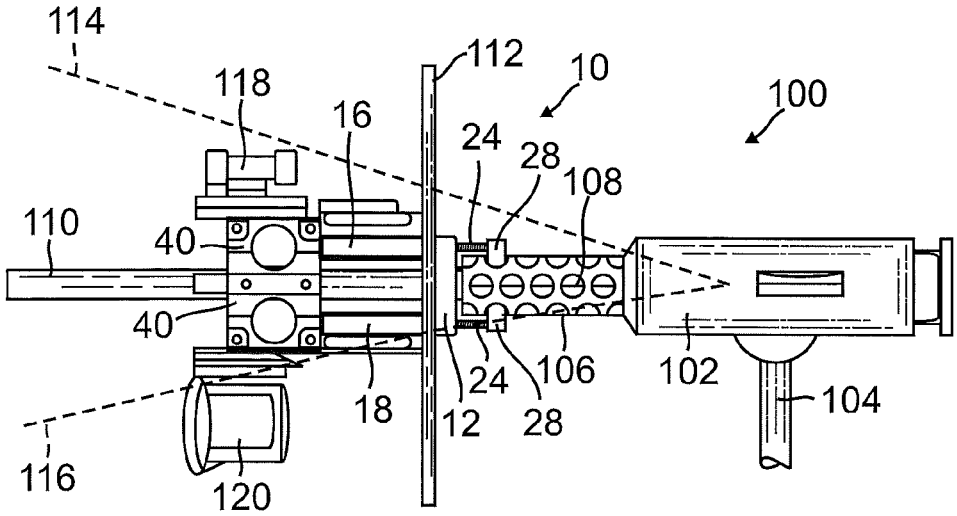

1-4, since as discussed above, QCBs 110 cannot be used with ballistic shields 112 of the type illustrated in FIGS. 19 and 20, because the QCB handle 111 would interfere with the ballistic shield 112. Accordingly, in the embodiment of FIG. 10, the right and left sides of the tines 16 and 18 are respectively coplanar, as are the right and left front faces of the annular mounting base 12.

FIGS. 11-14 illustrate an example embodiment of an optional accessory side mounting clamp 40 that can be used with the accessory mounts 10 of the present disclosure. As illustrated in the figures, the side mounting clamp 40 comprises an arcuate or C-shaped part having upper and lower ends 42, 44, each of which incorporates a laterally facing land 46 that is adapted to fit into a corresponding one of a pair of complementary elongated grooves 17 and 19 (see FIG. 10) extending along opposite sides of each of the upper and lower tines 16 and 18 of the mount 10. The clamp 40, in turn, includes an elongated groove 50 extending along one side that is adapted to receive an accessory mounting rail 34 for mounting a gun accessory, such as a gun sight 118, on a side of the accessory mount 10 in the manner described below, and may also include one or more lightening holes 52 for weight reduction.

Figure 11:
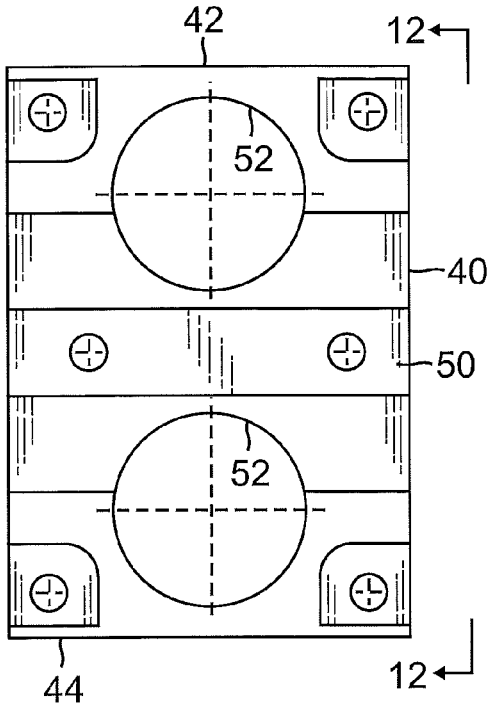
FIG. 11 is a side elevation view of an example embodiment of an optional C-shaped accessory side mounting clamp that can be used with the accessory mounts of the present disclosure.
Figure 12:
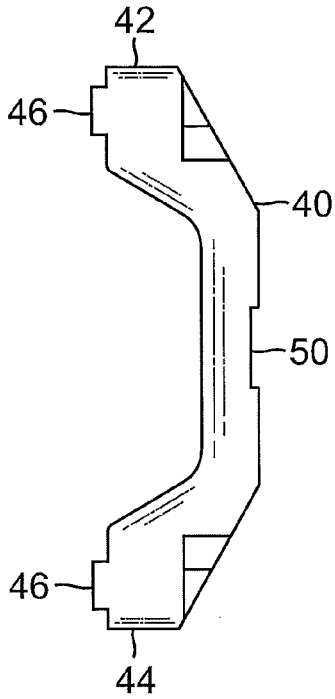
FIG. 12 is an end view of the example side mounting clamp of FIG. 11, as seen along the lines of the section 12-12 taken therein.
Figure 13:
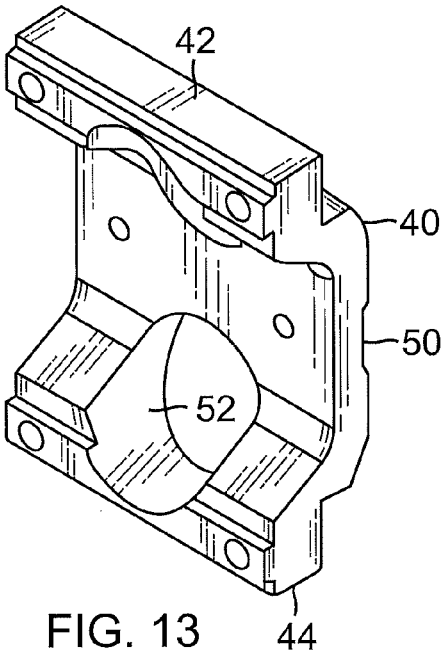
FIG. 13 is an upper front and inner side perspective view of the accessory side mounting clamp.
Figure 14:
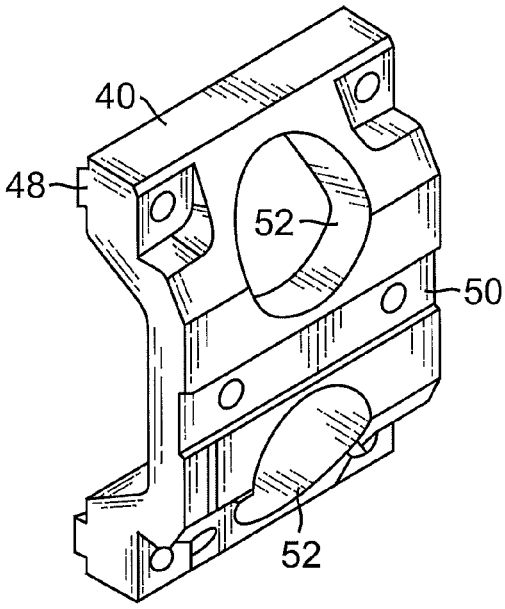
FIG. 14 is an upper front and outer side perspective view of the accessory side mounting clamp.

As may be seen in the front elevation view of the accessory side mounting clamp 40 of FIG. 11, the clamp 40 is bilaterally symmetrical about both vertical and horizontal central axes, thereby rendering the clamp 40 usable on either side of a mount 10. The clamp 40 may be fabricated by a variety of manufacturing techniques and from a variety of materials. In one embodiment, the clamp 40 is machined from an aluminum alloy, e.g., 6061-T6, and then may be hard anodized for corrosion resistance.

Figure 15:
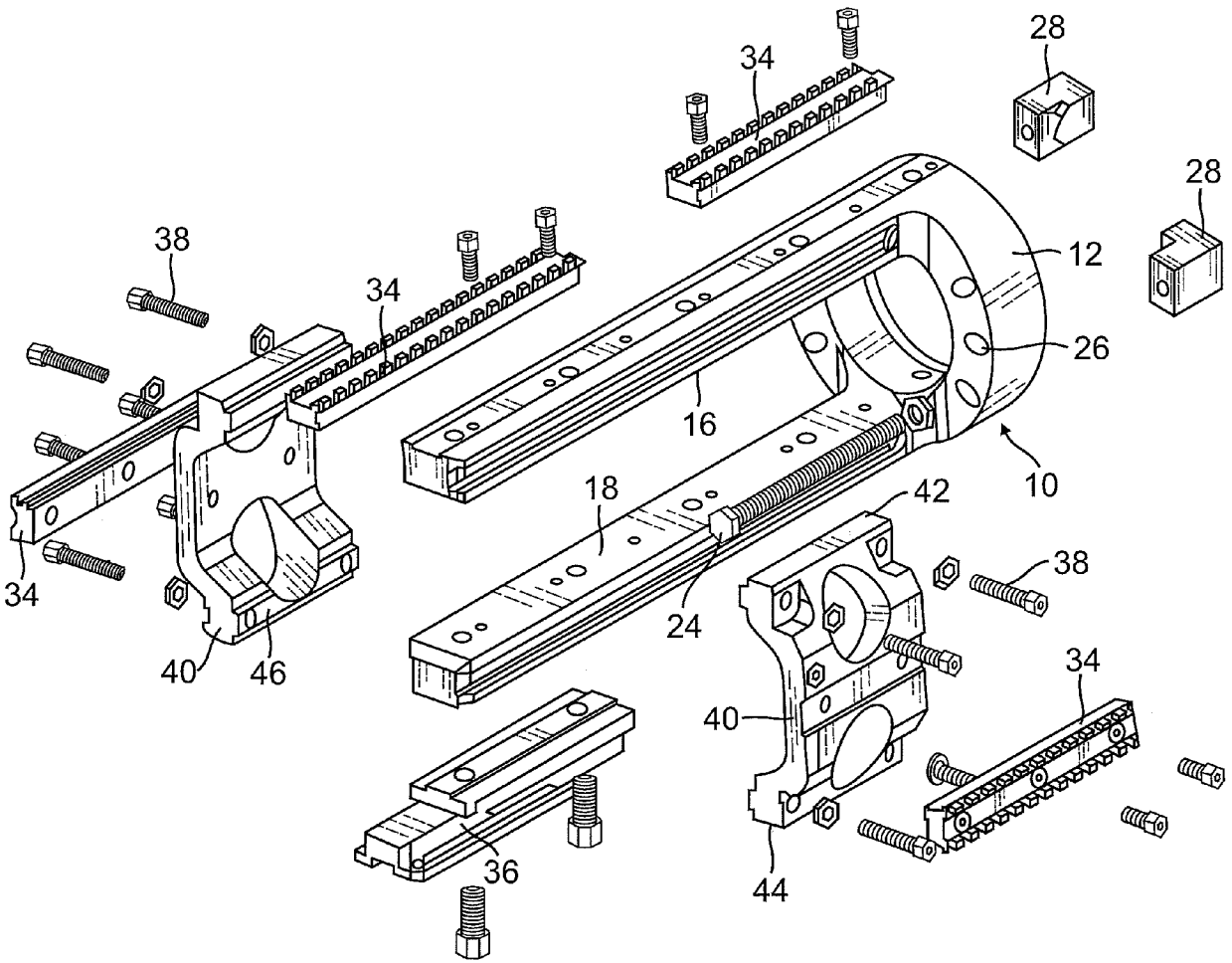
FIG. 15 is an exploded perspective view of the long-tine accessory mount of FIG. 10, showing the mounting thereto of a pair of the accessory side mounting clamps of FIG. 11.
Figure 16:
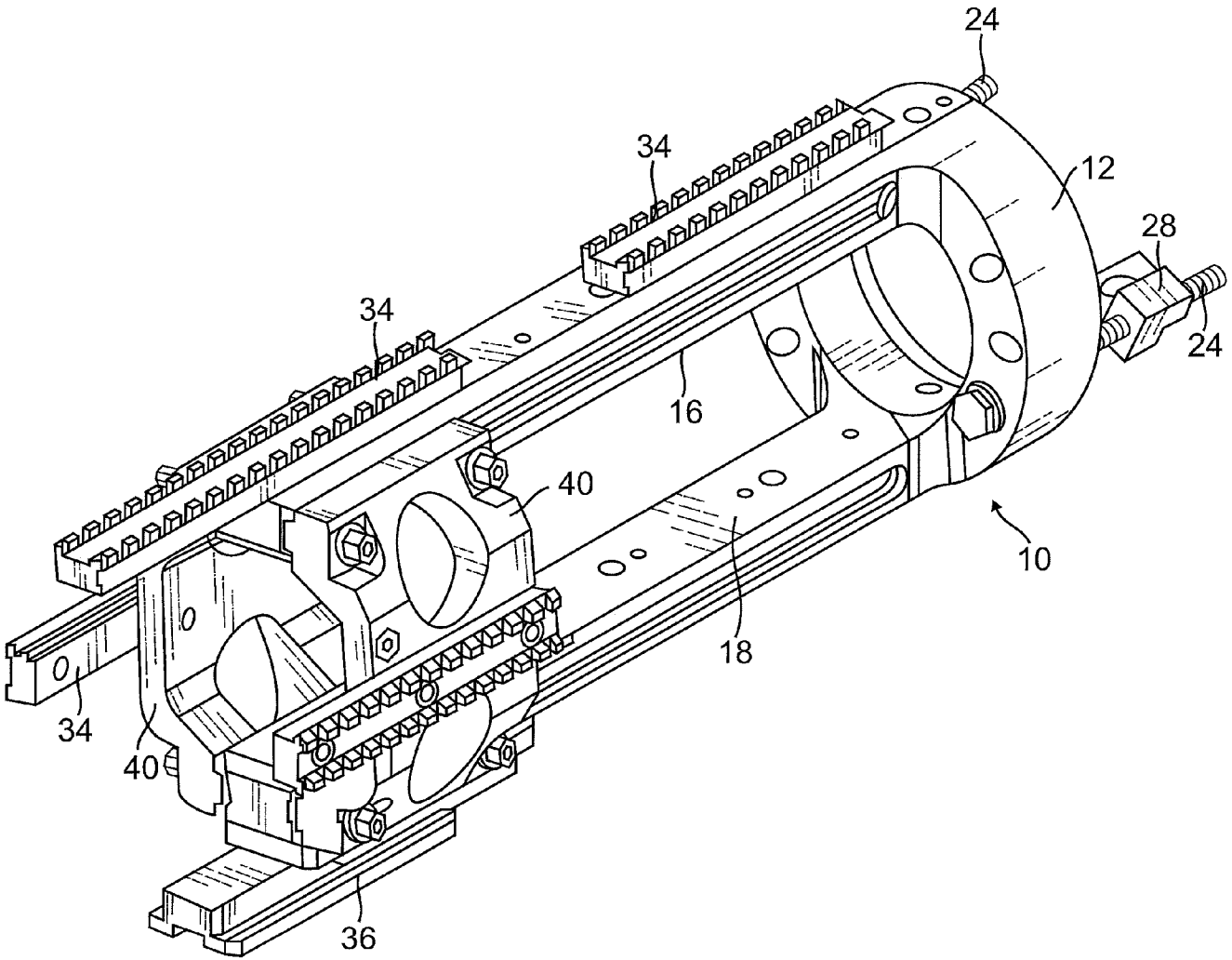
FIG. 16 is a perspective view of the accessory mount and side mounting clamps of FIG. 15, shown in the assembled condition.

FIG. 15 is an exploded upper front and side perspective view of the elongated-tine accessory mount 10 of FIG. 10, with a pair of the optional accessory side mounting clamps 40 mounted on opposite sides thereof, and FIG. 16 is a similar view of the accessory mount 10 and side mounting clamps 40 shown in a fully assembled state. As may be seen in these figures, the laterally facing lands 46 on the upper and lower ends 42 and 44 of the clamps 40 are respectively disposed in the grooves 17 and 19 in the sides of corresponding ones of the upper and lower tines 16 and 18 of the mount 10 with, e.g., a plurality of threaded fasteners 38, and an accessory mounting rail 34, such as a picatinny rail, is in turn mounted in the groove 50 on the outer side of each of the mounting clamps 40. As may be seen in the figures, any one of the accessory mounting rails 34, 36 may be mounted on its respective mounting surface such that the rail is either flush with or extends forwardly of the front end of the mount 10.

As will be appreciated, the foregoing "double-sided" arrangement enables four gun accessories, such as gun sights 118 or spotlights 120, to be mounted to a heavy machine gun 100 simultaneously, disposed at 90 degree increments relative to each other. Also, it should be understood that, although the example embodiment illustrated incorporates two of the optional accessory side mounting clamps 40, i.e., one on each side of the mount 10, it is also possible to use only a single clamp 40 on either side of the mount 10 for the side-mounting of a single accessory.

FIGS. 18-20 are partial left side elevation views of a heavy machine gun 100 having various embodiments of the accessory mount 10 of the present disclosure mounted thereon. The gun 100 may comprise, for example, a Browning .50 caliber M2HB heavy machine gun. The gun includes a receiver 102 that is typically mounted on a stand 104 of a type that enables a barrel 110 of the gun to be traversed left and right and elevated up and down. The gun further includes a shroud 106 that incorporates a plurality of circular holes 108 disposed in a regular pattern therein, and the elongated, rifled barrel 110 that is supported by the shroud 106 and receiver 102 to move axially in a reciprocating manner relative to the shroud and receiver, and hence, an accessory mount 10 mounted thereto, during firing of the gun 100.

As illustrated in FIGS. 17 and 18, the gun 100 may include a QCB 110 incorporating a handle 111 used to rotate the barrel relative to the receiver 102 in order to change out the barrel 110. As discussed above, the short-tined embodiment of mount 10 illustrated in FIGS. 1-4 enables a pair of accessories, such as a gun sight 118 and a spotlight 120 to be mounted to the gun, and further, enables the QCB 110 to be removed from the gun 100 and replaced with a new barrel, without having to remove either the accessory mount 10 or the accessories mounted thereon.

Alternatively, as illustrated in the embodiments of FIGS. 19 and 20, the gun 100 may be equipped with a ballistic shield 112 having an elongated vertical slot within which the barrel 110 of the gun 100 is pivotally disposed for continuous pivotal movement between positions of maximum and minimum elevation 114 and 116, indicated by the dashed lines in the figures. The ballistic shield 112, which is made a heavy thickness of steel, is fixed relative to the gun and is disposed so as to protect the gunner from enemy fire.

The gun 100 illustrated in FIGS. 17 and 18 does not include a ballistic shield, and consequently, can utilize the short-tined version of the accessory mount 10 of FIG. 1, whether it includes a QCB 110 and handle 111 or not. As described above, the mount 10 is mounted to the gun by disposing the recess 23 of the annular base 12 of the mount concentrically over the bushing 106A at the front of the shroud 106 of the gun, with the upper and lower tines 16 and 18 of the mount disposed one above the other, or tilted at an appropriate angle relative to a QCB barrel handle 111, if any, and the mount is then slid rearwardly until the floor 23B of the recess abuts the nose, or front surface 106B of the shroud 106.

The cleats 28 disposed near the ends of the rearwardly extending bolts 24 are then inserted into respective ones of adjacent circular holes 108 in the shroud 106 until the arcuate surface 32A of the gripping hook 32 of each of the cleats 28 is disposed adjacent to a front edge of the corresponding shroud hole. The bolts 24 are then turned so as to advance them into the respective cleats 28, or alternatively, into respective nuts 29 disposed behind the cleats, thereby pulling the mount 10 toward the shroud 106, until the floor 23B of the recess 23 in the rear of the annular base 12 of the mount 10 is pulled against and held firmly in contact with the front surface 106B of the shroud 106. As illustrated in FIG. 18, an accessory, such as a gun sight 118 or a spotlight 120, may then be mounted on the mounting rails of each of the upper and lower tines 16 and 18 of the mount 10.

As those of skill in the art will appreciate, when the gun 100 includes a ballistic shield 112, as illustrated in the embodiments of FIGS. 19 and 20, the upper and lower tines 16 and 18 of the mount 10 must protrude forwardly through the narrow vertical slot in the shield 112 so that the accessories can be mounted forward of the shield. In such machine gun embodiments, the elongated-tine version of the mount 10, such as illustrated in FIG. 10, is therefore indicated, and as those of skill in the art will appreciate, the respective lengths of the upper and lower tines 16 and 18 and the respective longitudinal mounting positions of the accessory mounting rails 34 and 36 respectively mounted thereon must be such that, during pivotal movement of the barrel 110 between the two extreme positions of elevation 114 and 116 of the barrel 110 shown in FIGS. 19 and 20, the accessories 118 and/or 120 respectively mounted on the upper and/or lower tines 16 and 18 will clear the ballistic shield 112 at every position of the barrel 110. Additionally, as illustrated in FIG. 20, if desired, one or two of the optional C-shaped mounting clamps 40 can be respectively mounted on the sides of the long-tined version of the mount 10 and used to mount one or two additional accessories on the sides of the mount 10.

By now, those of skill in this art will appreciate that many modifications, substitutions and variations can be made in and to the materials, apparatus, configurations and methods of the heavy machine gun accessory mounts of the present disclosure without departing from its spirit and scope. Accordingly, the scope of the present disclosure should not be limited to the particular embodiments illustrated and described herein, as they are merely by way of some examples thereof, but rather, should be fully commensurate with that of the claims appended hereafter and their functional equivalents.

What is claimed is:

1. An accessory mount for a gun, the mount comprising:

a base configured for attachment of the accessory mount to the gun, wherein the base comprises an annular structure having a circular central opening configured to be disposed concentrically over a barrel of the gun while the barrel extends entirely through the base, wherein the base comprises a concentric counterbore extending into a rear surface thereof, the counterbore defining a planar floor and being configured to be disposed concentrically over a front end of a shroud of the gun, with the floor of the counterbore disposed against a planar front surface of the shroud;

a pair of diametrically opposing accessory mounting tines disposed on and extending forwardly from a front face of the base, for mounting an accessory forward of the front face; and a holding mechanism for fixing the position of the base in relation to the gun, wherein the holding mechanism is arranged to pull the floor of the counterbore into contact with and hold it against the planar front surface of the shroud.

2. The accessory mount of claim 1, wherein:

the tines comprise an upper tine and a lower tine.

3. The accessory mount of claim 2, wherein the holding mechanism comprises:

a pair of threaded bolts extending rearwardly from the base through respective ones of a pair of diametrically opposing bolt apertures contained therein; and a pair of cleats, each having an opening through which a rear end portion of a respective one of the bolts extends and a hook adapted to grip an edge of a corresponding hole in the shroud of the gun, wherein the cleats are arranged such that advancement of the bolts into respective ones of the cleats causes the hook of each cleat to grip the edge of the corresponding hole in the shroud of the gun and the planar floor of the counterbore in the rear surface of the base to be pulled into contact with and held against the planar front surface of the shroud.

4. The accessory mount of claim 3, wherein the opening in at least one of the cleats is threaded, and wherein a corresponding one of the threaded bolts is disposed in threaded engagement with the opening of the at least one cleat.

5. The accessory mount of claim 3, wherein the opening in at least one of the cleats is unthreaded, and wherein a corresponding one of the threaded bolts is disposed in threaded engagement with a threaded nut disposed behind the at least one cleat.

6. The accessory mount of claim 2, wherein the pair of bolt apertures in the base comprises one of a plurality of diametrically opposing pairs of radially slotted bolt apertures arranged in a circumferential pattern around the base in such a way as to enable the accessory mount to be mounted to the gun in a plurality of angular positions relative to the barrel.

7. The accessory mount of claim 1, further comprising at least one accessory mounting rail mounted on a surface of a forward end portion of at least one of the accessory mounting tines.

8. The accessory mount of claim 7, wherein the at least one accessory mounting rail comprises a Picatinny rail.

9. The accessory mount of claim 7, further comprising at least one accessory mounted on the at least one accessory mounting rail.

10. The accessory mount of claim 9, wherein the at least one accessory comprises a gun sight or a spotlight.

11. The accessory mount of claim 9, wherein the at least one accessory comprises a telescopic, a laser, an infrared (IR) or a night vision device (NVD) gun sight.

12. The accessory mount of claim 7, wherein the at least one accessory mounting rail is mounted on a lower surface of a lower one of the tines of the mount, and further comprising a spotlight mounted on the mounting rail.

13. The accessory mount of claim 2, wherein:

the respective sides of the tines on a first side of the mount lie in respective planes intersecting the center of the central opening of the base and subtend an angle equal to or greater than about 150 degrees;

a front surface of the base on the first side of the mount is recessed behind a front surface of the base on an opposite second side thereof and includes a segment of an annular recess located adjacent to the central opening of the base; and a head of a corresponding one of the threaded bolts is recessed below the front surface of the base on the first side of the mount.

14. The accessory mount of claim 13, wherein:

the barrel of the gun comprises a quick change barrel (QCB) having an attached handle for rotating the barrel about a long axis of the barrel through an angle of about ±60 degrees relative to both the gun and the mount; and the barrel can be removed from the gun without removing the mount from the gun.

15. The accessory mount of claim 1, wherein the base and the accessory mounting tines comprise a single integral piece.

16. The accessory mount of claim 9, wherein:

the gun includes a ballistic shield through which the barrel of the gun extends for continuous pivotal movement between positions of maximum and minimum elevation relative thereto;

the tines of the mount protrude forwardly through the ballistic shield; and the respective lengths of the tines are such that, during pivotal movement of the barrel between the maximum and minimum positions thereof, the at least one accessory mounted on the at least one accessory mounting rail clears the ballistic shield at every position of the barrel.

17. The accessory mount of claim 1, further comprising:

at least one C-shaped accessory side mounting clamp having upper and lower ends respectively attached to a side of a respective one of the upper and lower tines of the mount; and an accessory mounting rail mounted on an outward facing side of the at least one accessory side mounting clamp.

18. A method for mounting an accessory on a heavy machine gun using the accessory mount of claim 3, the method comprising:

positioning the annular base of the mount concentrically about the barrel of the gun and such that the counterbore extending into the rear surface of the base is disposed concentrically over a front end of the shroud of the gun;

advancing the bolts into respective ones of the cleats such that the hook of each cleat grips an edge of the corresponding hole in the shroud of the gun and causes the planar floor of the counterbore in the rear surface of the base to be pulled into contact with and held against the planar front surface of the shroud;

mounting at least one accessory mounting rail on a forward end portion of at least one of the upper and lower tines of the mount; and mounting the accessory on the at least one accessory mounting rail.

19. The method of claim 18, wherein:

the gun includes a ballistic shield within which the barrel of the gun is supported for continuous pivotal movement between positions of maximum and minimum elevation; and wherein the positioning of the base further comprises positioning the upper and lower tines of the mount such they both protrude forwardly through the shield.

20. A heavy machine gun accessory mount, comprising:

an annular base having a circular central opening configured to be disposed concentrically over a barrel of the gun and a concentric counterbore extending into a rear surface thereof, the counterbore defining a planar floor and being configured to be disposed concentrically over a front end of a shroud of the gun;

a pair of diametrically opposing upper and lower accessory mounting tines extending forwardly from the base;

a pair of threaded bolts extending rearwardly from the base through respective ones of a pair of diametrically opposing bolt apertures contained therein;

a pair of cleats, each having an opening into which a rear end portion of a respective one of the bolts is received and a hook adapted to grip an edge of a corresponding hole in the shroud of the gun, the cleats being arranged such that advancement of the bolts into threads in respective ones of the openings of the cleats or into threaded nuts respectively disposed behind the cleats causes the hook of each cleat to grip the edge of the corresponding hole in the shroud and causes the planar floor of the counterbore in the rear surface of the base to be pulled into contact with and held against the planar front surface of the shroud; and at least one accessory mounting rail mounted on a surface of a forward end portion of at least one of the upper and lower tines of the mount.

21. The accessory mount of claim 20, further comprising:

at least one C-shaped accessory side mounting clamp having upper and lower ends respectively attached to a respective side of respective ones of the upper and lower tines of the mount; and an accessory mounting rail mounted on an outward facing side of the at least one accessory side mounting clamp.

* * * * *